US011858599B2

(12) United States Patent
Becker

(10) Patent No.: US 11,858,599 B2
(45) Date of Patent: Jan. 2, 2024

(54) DUAL MOTOR PROPULSION SYSTEM FOR WATERCRAFT

(71) Applicant: Matthew Adam Becker, North Fort Myers, FL (US)

(72) Inventor: Matthew Adam Becker, North Fort Myers, FL (US)

( * ) Notice: Subject to any disclaimer, the term of this patent is extended or adjusted under 35 U.S.C. 154(b) by 478 days.

(21) Appl. No.: 17/248,580

(22) Filed: Jan. 29, 2021

(65) Prior Publication Data

US 2021/0229780 A1 Jul. 29, 2021

Related U.S. Application Data

(60) Provisional application No. 62/967,420, filed on Jan. 29, 2020.

(51) Int. Cl.

| | |
|---|---|
| ***B63B 34/10*** | (2020.01) |
| ***B63H 20/02*** | (2006.01) |
| ***B63H 21/17*** | (2006.01) |
| ***B63H 21/21*** | (2006.01) |
| *B63H 20/00* | (2006.01) |

(52) U.S. Cl.

CPC ..... *B63B 34/10* (2020.02); *B63H 20/02* (2013.01); *B63H 21/17* (2013.01); *B63H 21/21* (2013.01); *B63H 2020/003* (2013.01)

(58) Field of Classification Search

None

See application file for complete search history.

(56) References Cited

U.S. PATENT DOCUMENTS

| | | | | |
|---|---|---|---|---|
| 4,226,206 | A | 10/1980 | Wilson | |
| 4,862,818 | A * | 9/1989 | Sullivan | B63H 16/06 114/364 |
| 5,131,875 | A | 7/1992 | Lee | |
| 5,389,017 | A * | 2/1995 | Huzjak | B63H 20/10 248/641 |
| 5,941,742 | A * | 8/1999 | Whitaker | B63H 20/007 114/364 |
| 6,054,831 | A | 4/2000 | Moore et al. | |
| 6,132,267 | A | 10/2000 | Campbell | |
| 6,401,644 | B2 | 6/2002 | Fadeley et al. | |
| 6,863,581 | B2 * | 3/2005 | Anderson | B63H 20/007 248/642 |
| D524,716 | S * | 7/2006 | Hill | D8/354 |
| 7,150,662 | B1 | 12/2006 | Janitz | |
| 7,556,544 | B2 | 7/2009 | Zimmerlee | |
| 8,516,973 | B1 | 8/2013 | Hamilton | |
| 9,623,947 | B1 * | 4/2017 | Wilson | B63H 20/12 |
| 9,738,364 | B2 | 8/2017 | Abney | |
| 9,988,130 | B2 | 6/2018 | Shin | |
| 10,011,329 | B1 * | 7/2018 | Cooper | B63B 32/10 |

(Continued)

*Primary Examiner* — Steven M Marsh

(74) *Attorney, Agent, or Firm* — Dunlap Bennett & Ludwig, PLLC

(57) ABSTRACT

A systemic dual motor framing for a watercraft is provided as is the overall system. The systemic dual motor framing is movable between a folded condition and an unfolded condition for attaching with the assistance of strapping to a stern of the watercraft, sleeve-like, either by sliding over the stern end or strapping around the stern. In the unfolded condition, the systemic dual motor framing facilities the strapping while maintaining a motor on each side of the watercraft, wherein the two motors can be selectively powered in conjunction remotely.

7 Claims, 3 Drawing Sheets

(56) References Cited

U.S. PATENT DOCUMENTS

| | | | | |
|---|---|---|---|---|
| 10,053,200 | B1 | 8/2018 | Koetsier et al. | |
| 10,082,788 | B1 | 9/2018 | Dengel et al. | |
| 10,266,237 | B2 | 4/2019 | Zimmerman et al. | |
| 10,618,621 | B1 | 4/2020 | Rott et al. | |
| 10,633,069 | B2 | 4/2020 | Reed | |
| 10,836,454 | B2 | 11/2020 | Walpurgis et al. | |
| 11,655,013 | B2 * | 5/2023 | Clegg | B63B 34/50 440/21 |
| 2006/0057910 | A1 | 3/2006 | Stallings | |
| 2009/0042461 | A1 | 2/2009 | Walton | |
| 2010/0136857 | A1 | 6/2010 | Goudsmit | |

* cited by examiner

DUAL MOTOR PROPULSION SYSTEM FOR WATERCRAFT

CROSS-REFERENCE TO RELATED APPLICATION

This application claims the benefit of priority of U.S. provisional application No. 62/967,420 filed 29 Jan. 2020, the contents of which are herein incorporated by reference.

BACKGROUND OF THE INVENTION

The present invention relates to watercraft propulsion systems and, more particularly, a dual motor watercraft propulsion system configured to enable handsfree piloting of smaller watercraft through synchronously operating the two motors.

Current small watercraft propulsion systems utilize a single motor, or possible two, operatively dissociated motors; for example, a primary motor and a second, 'trolling' motor. The trolling motor is usually a secondary means of propulsion aiming to provide precision maneuvering when trolling for game fish but, again, the primary motor and the trolling motor are not synchronized. Even though may be bolted or screwed into one mounting bracket to the transom. Furthermore, this installation usually takes many steps and requires tools and hardware that could damage the watercraft. Most importantly, both motors need to be controlled by hand, asynchronously.

In short, current small watercraft propulsion systems requires at least one permanently installed outboard motor, that takes many steps to install, and wherein even if there are two motors, they are asynchronous and do not give the user a hands-free operation.

As can be seen, there is a need for a dual, synchronous motor watercraft propulsion system configured to enable handsfree piloting.

The present invention embodies a systemic dual motor frame adapted to operatively associate two independent motors on opposing sides of the watercraft within minutes. The systemic dual motor frame slips on the end of the watercraft and uses straps that snug tight and secure the systemic dual motor frame to the vessel. The sleeve-like application of the systemic dual motor frame will not damage the watercraft and will allow the user to selectively (simultaneously and independently) control the two motors and thus the vessel with 360-degree motion capability by way of an easy-to-use wireless joystick.

This unique frame design is used with two stationary thrusters spaced far enough apart to be activated individually to apply steering. This frame design does not require the user to bolt or screw anything into the boat or kayak. The design allows the user to remove the motors very quickly, fold and store. The frame is also lightweight and designed for carrying by hand for long distance.

The dual motor system of the present invention will solve the problem a fishermen or sightseer may have with the ability to paddle or maneuver their water vessel, short or long distances. Using a wireless remote that can be attached to a fishing pole or used freeing standing, the user's hands can be freed to be used for fishing or sightseeing while still controlling the vessel in 360-degree motion.

SUMMARY OF THE INVENTION

In one aspect of the present invention, a systemic dual motor framing includes the following: a central portion providing two pivot points, wherein each pivot point pivotably connects to a motor arm; and each motor arm includes a strapping leaf; and a motor pivot point outboard of the strapping leaf, wherein the motor arm is movable about said two pivot points and the two motor pivot points between a folded condition and an unfolded condition.

In another aspect of the present invention, the systemic dual motor framing includes the following: wherein the unfolded condition includes a first portion of the motor arm and a second portion of the motor are generally orthogonally relative to each other; a motor connected to a distal end of each second portion; a hinged fork defining the motor pivot point and a leaf pivot point pivotably connecting the first portion of the motor arm to the strapping leaf, and wherein the motor pivot point and the leaf pivot point are nonplanar separate relative to each other; a strapping interconnecting the mirrored strapping leaves; and a control configured to independently and synchronously operate the two motors.

In yet another aspect of the present invention, a method of providing a watercraft with dual motor propulsion, the method comprising: sliding the above-mentioned systemic dual motor framing in the unfolded condition over a stern of the watercraft until a hull of the watercraft is snugly sandwiched between the strapping and two motor arms.

These and other features, aspects and advantages of the present invention will become better understood with reference to the following drawings, description and claims

DETAILED DESCRIPTION OF THE INVENTION

Figure 1:
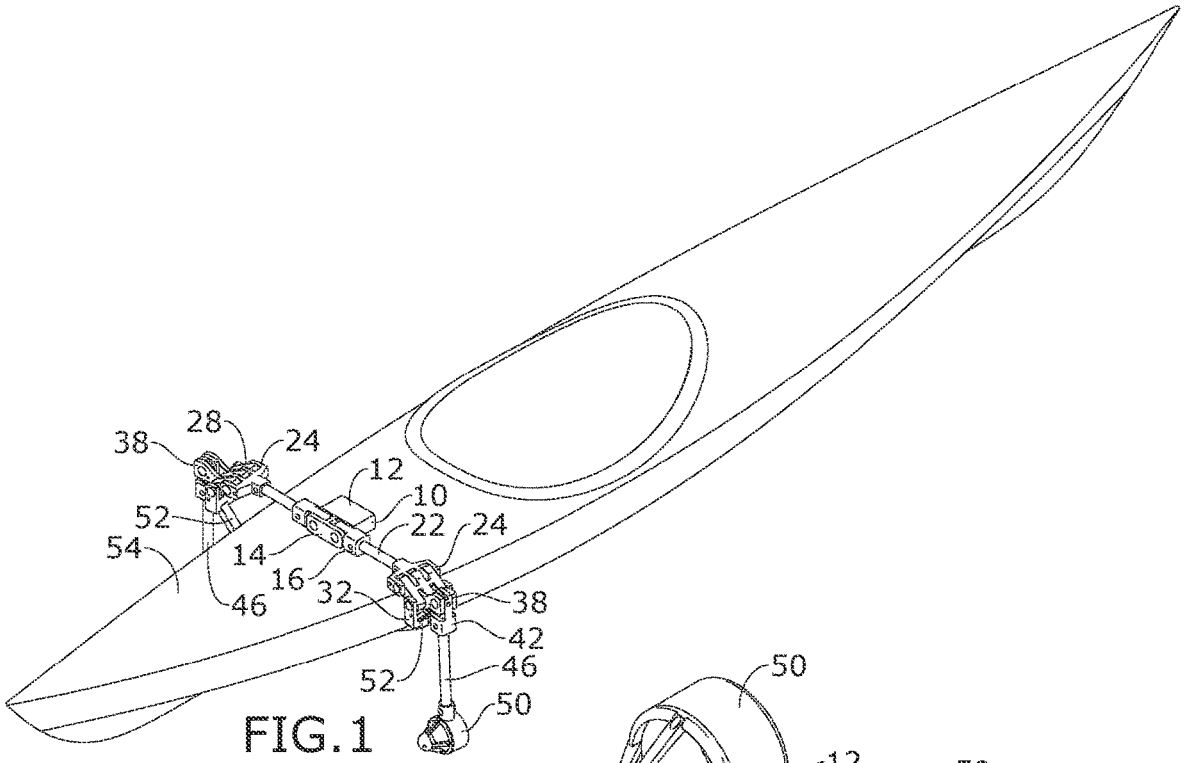
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a systemic dual motor framing for a watercraft. The systemic dual motor framing is movable between a folded condition and an unfolded condition for attaching with the assistance of strapping to a stern of the watercraft, sleeve-like, either by sliding over the stern end or strapping around the stern. In the unfolded condition, the systemic dual motor framing facilities the strapping and maintains a motor on each side of the watercraft, wherein the two motors can be selectively powered in conjunction remotely.

Referring now to FIGS. 1 through 4, the present invention may include the following systemic components: an electronics housing 10; a housing lid 12; a housing fork 14; a first coupling 16; a housing connecting rod 18; a first coupling fasteners 20; a first arm 22; a first hinge leaf 24; first hinge fasteners 26; first leaf connection rod 28; a hinge coupler 30; a second hinge leaf 32; strap slots 34; a second leaf connecting rod 36; a second hinge fork 38; a second coupling connecting rod 40; a second coupler 42; a second coupler fastener 44; a second arm 46; a motor connecting fastener 48; a motor 50; an exemplary strap 52; and the watercraft 54.

The systemic dual motor framing 100 (embodying systemic components 14 through 48) operatively associates two synchronously operated motors 50 spaced apart by the deck of the watercraft 54. The systemic dual motor framing 100 may also support a control circuitry for the motors 50; the control circuitry being housed in the electronics housing 10, which has a housing lid 12 for accessing the control circuitry. The systemic dual motor framing 100 operatively associates to the bottom-most longitudinal structural element of the watercraft 54 by way of strapping 52.

The systemic dual motor framing 100 may be symmetrical. mirrored relative to a housing fork 14. The housing fork 14 provides two pivot points (one pivot point for each side of the mirrored systemic dual motor framing 100. The two pivot points are disposed along two coplanar separate (if each axis is seen as one center of two circles/two sets of holes) axis of rotation 19, respectively.

Each pivot point pivotably connects, by way of the housing connecting rod 18, the first coupling 16 on each side of the housing fork 14. The first arm 22 then secures to the first coupling 16, by way of the first coupling fasteners 20, and the first arm 22 extends to and pivotably connects (by way of the first hinge fasteners 26) to the first hinge leaf 24. The first leaf connection rod 28 pivotably associates the first hinge leaf 24 and the second hinge leaf 32 about a proximate axis of rotation 29 (by way of the hinge coupler 30) and a distal axis of rotation 35 (by way of the second leaf connecting rod 36), respectively.

The second hinge leaf 32 provides strap slots 34 for the strapping 52 to connect the systemic frame 100 to the bottom-most portion of the watercraft 45. The second hinge leaf 32 also supports the second hinge fork 38, wherein the second hinge fork 38 provides two nonplanar separated (if each axis is seen as one center of two circles/two sets of holes) axis of rotation—the distal axis of rotation 35 and a motor axis of rotation 39.

The motor axis of rotation 39 (by way of the second coupling connecting rod pivotably connects to a second coupler 42 that supports the second arm 46 through the second coupler fasteners 44. The distal end of the second arm 46 connects to the motor 50 by way of a motor connecting fastener 48.

Figure 2:
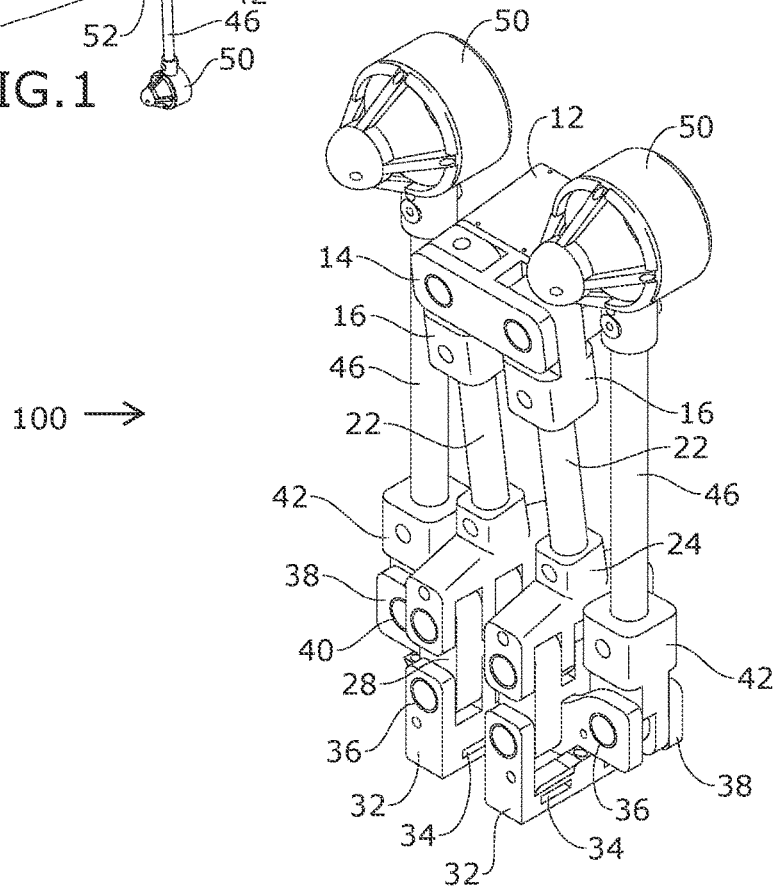
FIG. 2 is a perspective view of an exemplary embodiment of the present invention, shown in a folded, stored condition.
Figure 3:
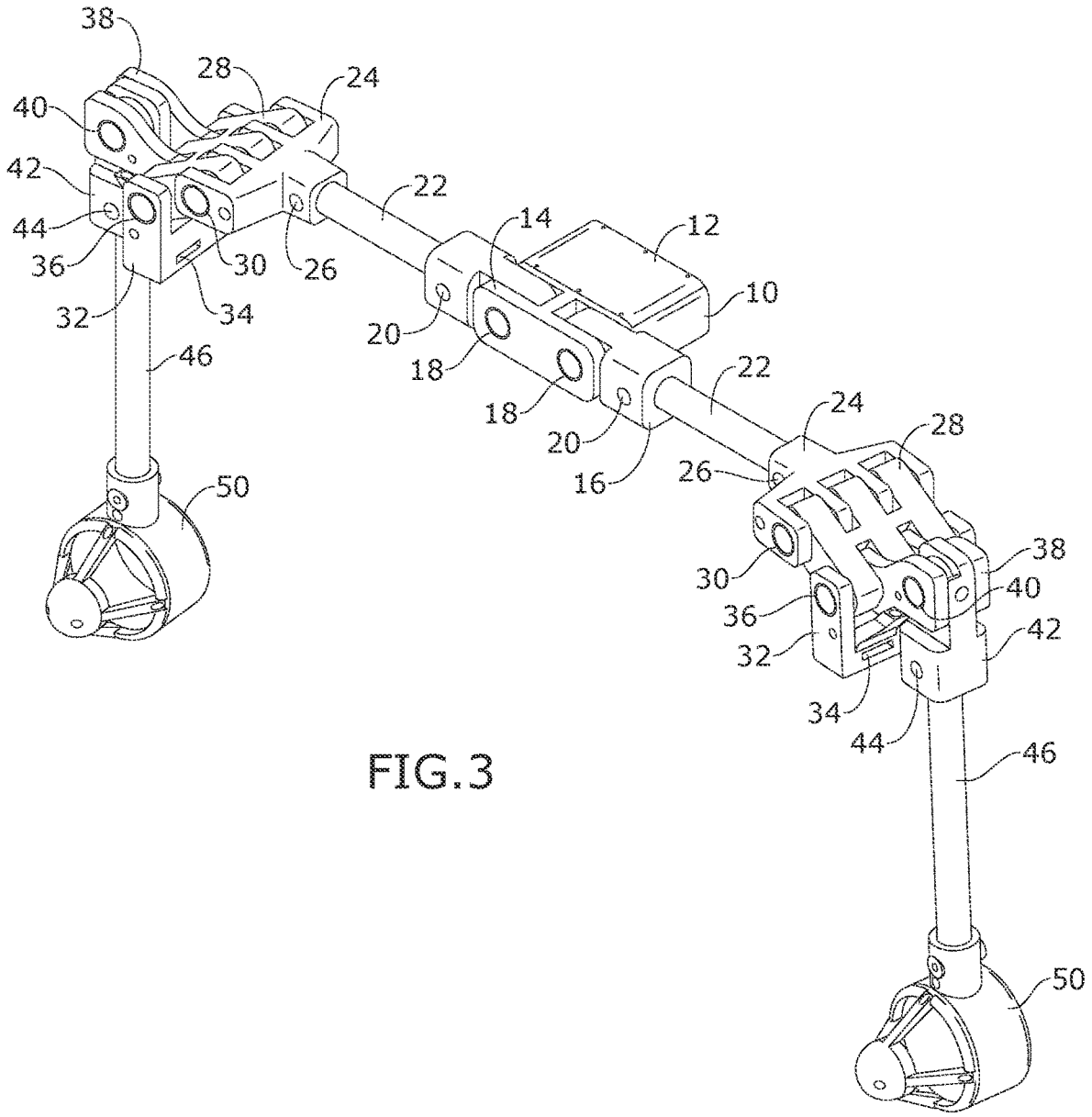
FIG. 3 is a perspective view of an exemplary embodiment of the present invention, shown in an unfolded, deployed condition.
Figure 4:
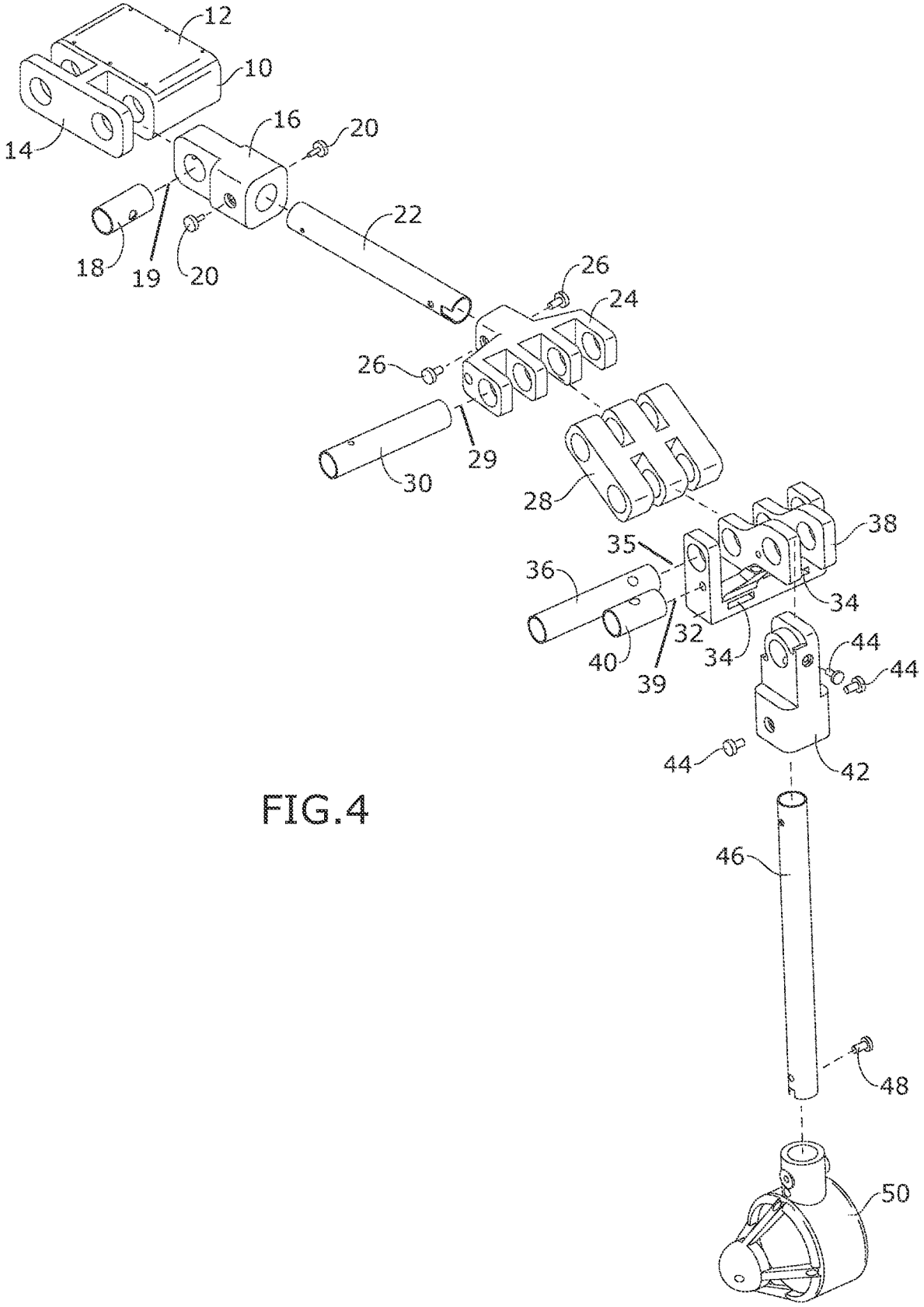
FIG. 4 is a detailed exploded view of an exemplary embodiment of the present invention.

The systemic frame 100 is designed in such a way to allow strength and flexibility at precise joints (the axis of rotations: 19, 29, 35, 39) so as to be movable between a folded, stored condition, as illustrate in FIG. 2, and a unfolded, deployed condition, as illustrated in FIG. 3, to effectively slip onto the end of the watercraft 54 (e.g., boat or kayak), wherein the two motors are on opposing sides of the watercraft 54. The design uses these two motors 50 in conjunction with proper spacing to which steering can be achieved without the need of turning the motors 50 or using a rudder.

The proper spacing is defined as the width of deck that the systemic frame 100 accommodates in the deployed condition, which can range from 12 to 60 inches. The dual motor design will allow 360 motion control with the use of a wireless joystick. The frame is designed to be unstrapped and folded at its joints to then be packed away within a bag and easily carried over one's shoulder or inside a bag, in the folded, stored condition.

The logic controller inside the remote has programing used to transmit signals via wireless communication to the logic controller built inside the electronics housing of the systemic dual motor framing 100. The logic controller within the systemic dual motor framing 100 accepts signals from the wireless two-axis joystick and transmits this data directly to the dual electric motors.

A method of making the present invention may include the following. A manufacturer may use additive manufacture (three-dimensional printing) or injection molding to create a frame having connections to aluminum round tubes (the first connecting rod 18, for instance). The frame is designed using lightweight materials with various joints to allow easy movability and to fold then store. The aluminum tubes will be connected to two underwater electric motors attached to a propeller respectively acting as thrusters. The frame will hold a single motor on each side, in (certain embodiments) a hexagon type shape with a string mesh strap enforcing the bottom side of the hexagon shape.

The electrical system may require designing two printed circuit boards: one for the wireless remote and the other for the master board inside the frame. Both boards require extra hardware to be attached such as battery's, joysticks, ECS's terminal blocks and wiring. Therefore, the manufacturer may need to assemble wiring and program two logic controllers to commutation via a wireless remote effectively controlling each motor with variable speed and direction.

The dual motors and the systemic frame design are necessary to produce the inventive concept. The wireless remote can be optional as there could be a wired remote. Various battery packs are also optional. The system could be upgraded to bigger motors to accommodate a larger boat or kayak and some software improvements could be added to allow GPS guided control or speed control.

The dual motor frame could be thinner and smaller to fit paddle boards with the same 360 motion control and joystick remote. Also, the dual motor frame could be increased in size to fit larger boats and control them in the same way. The battery pack can be mounted on the frame giving the user one compact dual motor system.

A method of using the present invention may include the following. The systemic dual motor frame 100 disclosed above may be provided, and the following steps employed. Step One, the user would unfold the systemic dual motor frame 100 and slide the systemic dual motor frame 100 onto the stern of the watercraft 54 aligning the mesh strapping 52 underneath the vessel 54. Step Two, the user would continue to slide the systemic dual motor frame 100 up until the systemic dual motor frame 100 is tight due to the tapering shape of narrowing watercraft 54, likes canoes and kayaks. Step Three, the user could use ratchet straps to continue and completely tighten the systemic dual motor framing 100 to the vessel 54. Step Four, the user will board the watercraft 54 and lower the motors 50 into the water and begin using with wireless joystick.

Additionally, the present invention could be used as an autonomous driving boat or kayak for handicapped or to carry supplies on a voyage within the water.

It should be understood, of course, that the foregoing relates to exemplary embodiments of the invention and that modifications may be made without departing from the spirit and scope of the invention as set forth in the following claims.

What is claimed is:

1. A systemic dual motor framing, comprising:

a central portion providing two pivot points, wherein each pivot point pivotably connects to a motor arm; and each motor arm comprises:

a strapping leaf; and a motor pivot point outboard of the strapping leaf, wherein the motor arm is movable about said two pivot points and the two motor pivot points between a folded condition and an unfolded condition.

2. The systemic dual motor framing of claim 1, wherein the unfolded condition comprises a first portion of the motor arm and a second portion of the motor arm that are generally orthogonally relative to each other.

3. The systemic dual motor framing of claim 2, further comprising a motor connected to a distal end of each second portion.

4. The systemic dual motor framing of claim 3, further comprising a hinged fork defining the motor pivot point and a leaf pivot point pivotably connecting the first portion of the motor arm to the strapping leaf, and wherein the motor pivot point and the leaf pivot point are nonplanar separate relative to each other.

5. The systemic dual motor framing of claim 4, further comprising a strapping interconnecting the mirrored strapping leaves.

6. The systemic dual motor framing of claim 5, further comprising a control configured to independently and synchronously operate the two motors.

7. A method of providing a watercraft with dual motor propulsion, the method comprising:

sliding the systemic dual motor framing of claim 6 in the unfolded condition over a stern of the watercraft until a hull of the watercraft is snugly sandwiched between the strapping and two motor arms.

* * * * *